US007267450B2

(12) United States Patent
Ha

(10) Patent No.: US 7,267,450 B2
(45) Date of Patent: Sep. 11, 2007

(54) LAMP ASSEMBLY AND COOKING APPARATUS HAVING THE SAME

(75) Inventor: Yu Jeub Ha, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 204 days.

(21) Appl. No.: 10/869,846

(22) Filed: Jun. 18, 2004

(65) Prior Publication Data

US 2005/0122709 A1 Jun. 9, 2005

(30) Foreign Application Priority Data

Dec. 9, 2003 (KR) ..... 10-2003-0089139

(51) Int. Cl.
*F21V 33/00* (2006.01)

(52) U.S. Cl. ..... 362/92; 362/374; 362/376; 219/758

(58) Field of Classification Search ..... 362/92, 362/374, 375, 376; 219/679, 758; 126/97; 312/236

See application file for complete search history.

(56) References Cited

U.S. PATENT DOCUMENTS 2,332,362 A * 10/1943 Bartow ..... 362/311
3,604,783 A * 9/1971 Roth ..... 362/92
4,621,180 A * 11/1986 Kristof et al. ..... 219/758
4,628,417 A * 12/1986 Kaminski et al. ..... 362/485
4,771,154 A * 9/1988 Bell et al. ..... 219/685
5,180,219 A * 1/1993 Geddie ..... 362/546
6,093,919 A 7/2000 Seo et al.
6,448,540 B1 * 9/2002 Braunisch et al. ..... 219/685
6,700,107 B2 * 3/2004 Lee ..... 219/757
D493,559 S * 7/2004 Park ..... D26/74

* cited by examiner

*Primary Examiner*—Renee Luebke
*Assistant Examiner*—Gunyoung T. Lee
(74) *Attorney, Agent, or Firm*—Staas & Halsey LLP

(57) ABSTRACT

A cooking apparatus having a lamp assembly. The lamp assembly includes a lamp casing having elastic tongues at both sides thereof and mounted with a lamp therein, and a transparent cover having locking depressions at both sides thereof and inserted into the lamp casing. The elastic tongues are formed by cutting the lamp casing and are provided with projections at free ends thereof to be caught by the locking depressions. The lamp casing is combined with a sidewall plate fastening a front flange of the lamp casing to the sidewall plate. The transparent cover is inserted into the lamp casing, and is provided with an inserted part on which the locking depressions are formed. A lamp protecting memberincluding holes having sizes to prevent microwaves from passing therethrough, is placed between the lamp casing and the transparent cover.

11 Claims, 7 Drawing Sheets

LAMP ASSEMBLY AND COOKING APPARATUS HAVING THE SAME

CROSS-REFERENCE TO RELATED APPLICATIONS

This application claims the benefit of Korean Patent Application No. 2003-89139, filed Dec. 9, 2003 in the Korean Intellectual Property Office, the disclosure of which is incorporated herein by reference.

BACKGROUND OF THE INVENTION

1. Field of the Invention

The present invention generally relates to a lamp assembly and a cooking apparatus having the lamp assembly and, more particularly, to a lamp assembly that is structured to allow a lamp to be quickly and conveniently replaced, and a cooking apparatus having the lamp assembly.

2. Description of the Related Art

In general, a cooking apparatus, such as a microwave oven or an electric oven, is provided with a cooking cavity therein. In the cooking cavity of the cooking apparatus, a lamp is installed to illuminate the cooking cavity and to allow a user to observe food being cooked.

The lamp is detachably installed in a lamp assembly mounted on one side of the cooking cavity. When a life span of the lamp ends, the lamp assembly is removed from the side of the cooking cavity and the lamp is replaced. The conventional lamp assembly includes a lamp casing on which the lamp is mounted, and a glass cover which prevents food from adhering to the lamp and passes light therethrough.

The lamp casing is formed in approximately a box shape which is open at a front thereof to accommodate the lamp. A flange is provided on an edge of the open front of the lamp casing to be radially outwardly extended therefrom.

The glass cover includes a rectangular frame opened at a center portion thereof, and a glass fitted into the open center portion. The rectangular frame is sized to come in contact with the flange of the lamp casing, and is mounted on the open front of the lamp casing.

In the meantime, the lamp assembly may be mounted on a microwave oven, or an electric oven performing a same function as the microwave oven. When the lamp assembly is mounted on the cooking apparatus that cooks food by irradiating microwaves into the cooking cavity, there must be provided a lamp protecting element to intercept the microwaves not to be irradiated to the lamp and to therefore prevent the lamp from being damaged.

For this purpose, the lamp assembly is provided with a lamp protecting plate that is located between the lamp casing and the glass cover and is perforated with holes each having a size that allows a hole to prevent microwaves from passing therethrough over an entire surface of the lamp protecting plate.

When the lamp assembly (which includes the lamp casing), the lamp protecting plate and the glass cover, are mounted on an upper plate or a sidewall plate of the cooking cavity and food is cooked by microwaves or electricity in the cooking cavity with the lamp being turned on, the user may observe an inside of the cooking cavity from outside the cooking cavity.

The conventional lamp assembly is constructed to be mounted on a sidewall plate of the cooking cavity by inserting a plurality of screws into screw holes arranged close to each other and formed along the flange of the lamp casing, the frame of the glass cover and an edge of the lamp protecting plate.

As a result, to replace the lamp installed on the lamp casing, the plurality of screws are withdrawn from the screw holes. The glass cover, the lamp protecting plate and the lamp casing are separated from each other, the lamp is removed from the lamp casing and replaced. Then the glass cover, the lamp protecting plate and the lamp casing are screwed into the sidewall plate of the cooking cavity again. Therefore, the cooking apparatus having the conventional lamp assembly is disadvantageous because it is inconvenient and requires excessive time to replace the lamp.

SUMMARY OF THE INVENTION

Accordingly, it is an aspect of the present invention to provide a lamp assembly that allows a lamp to be quickly and conveniently replaced, and a cooking apparatus having the lamp assembly.

Additional aspects and/or advantages of the invention will be set forth in part in the description which follows and, in part, will be obvious from the description, or may be learned by practice of the invention.

The above and/or other aspects are achieved by providing a cooking apparatus, which includes a cooking cavity, an opening formed through a side of the cooking cavity, and a lamp assembly mounted on the opening, the lamp assembly including a lamp casing mounted with a lamp and a transparent cover combined with the lamp casing to be separated from the lamp casing.

One of the lamp casing and the transparent cover may be provided with an elastic tongue, another one of the lamp casing and the transparent cover may be provided with a locking depression to engage with the elastic tongue.

The elastic tongue may be formed to have a predetermined size by cutting a portion of one side of the lamp casing to be radially and elastically deformed and has a projection at a free end thereof, and the locking depression may be formed on a side of the transparent cover that engages with the elastic tongue.

The locking depression and the projection are approximately wedge shaped to be selectively engaged with and disengaged from each other as the transparent cover is selectively inserted into and removed from the lamp casing.

The lamp casing may include a flange radially outwardly extending from a front edge thereof, and the transparent cover may include a base plate covering a front of the lamp casing, and an inserted part extending from the base plate to a predetermined length to be inserted into the lamp casing.

The lamp casing may be fastened to the side of the cooking cavity by welding the flange of the lamp casing to a portion of the side of the cooking cavity around the opening.

The lamp assembly may further include a fastening plate having a frame constructed to correspond to the flange of the lamp casing and a plurality of bolts so that the lamp casing is fastened to the side of the cooking cavity by tightening nuts on the bolts passing through the flange of the lamp casing and the side of the cooking cavity.

The cooking apparatus cooks food using microwaves, and may further include a lamp protecting member, the lamp protecting member being located between the lamp casing and the transparent cover and perforated with a plurality of holes each having a size that allows the hole to prevent the microwaves from passing therethrough.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
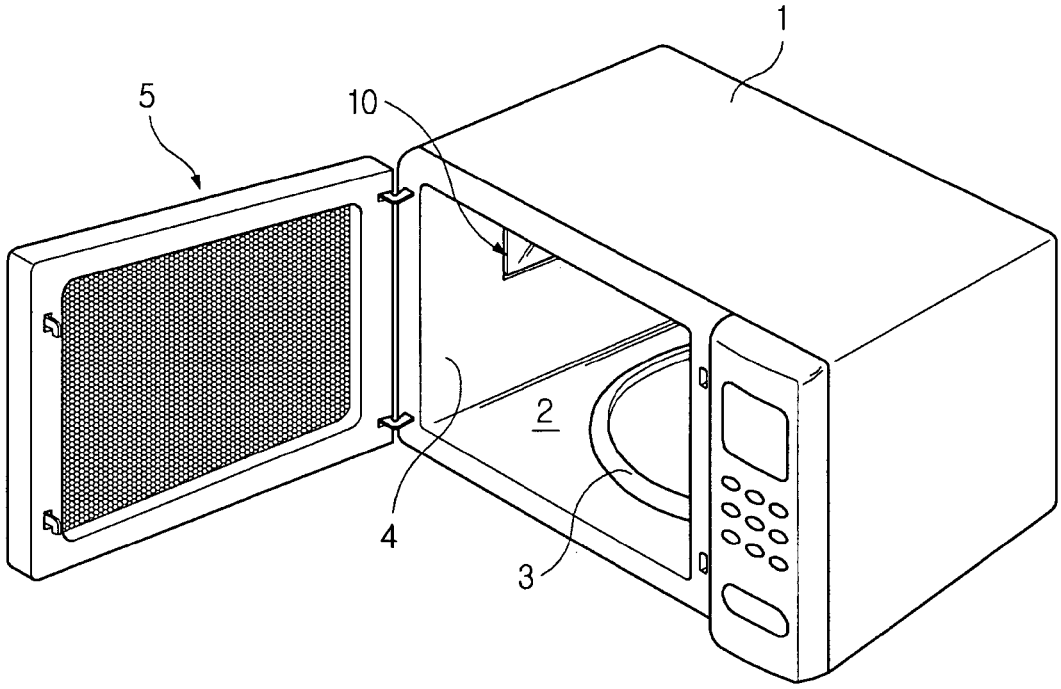
FIG. 1 is a perspective view showing a cooking apparatus with a lamp assembly mounted thereon, according to embodiments of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

FIG. 1 is a perspective view showing a lamp assembly 10 mounted on a cooking apparatus that cooks food using microwaves, such as a microwave oven, according to embodiments of the present invention. As shown in FIG. 1, the microwave oven, on which the lamp assembly 10 is mounted, includes a body 1 configured to form the appearance of a microwave oven, a cooking cavity 2 and an electrical component area (not shown) formed by partitioning an interior of the body 1. The microwave oven cooks food using microwaves emitted from the electrical component area to the cooking cavity.

A turntable 3 is placed on a bottom of the cooking cavity 2 to uniformly transmit microwaves to food while rotating at a low speed with the food placed thereon. A door 5 is attached to an open front of the cooking cavity 2 to selectively open and close the cooking cavity 2.

Since the lamp assembly 10 is mounted on a sidewall plate 4 of the cooking cavity 2 and irradiates light, a user may observe the food being cooked from outside the cooking cavity 2.

Although in FIG. 1, the lamp assembly 10 has been illustrated as being mounted on a left-side wall of the cooking cavity 2, the embodiments of the present invention are not limited to this illustration. The lamp assembly 10 may be mounted on a right-side wall, an upper surface or a lower surface of the cooking cavity 2. Furthermore, the lamp assembly 10 may be mounted on cooking apparatuses other than the microwave oven, such as an electric oven.

Figure 2:
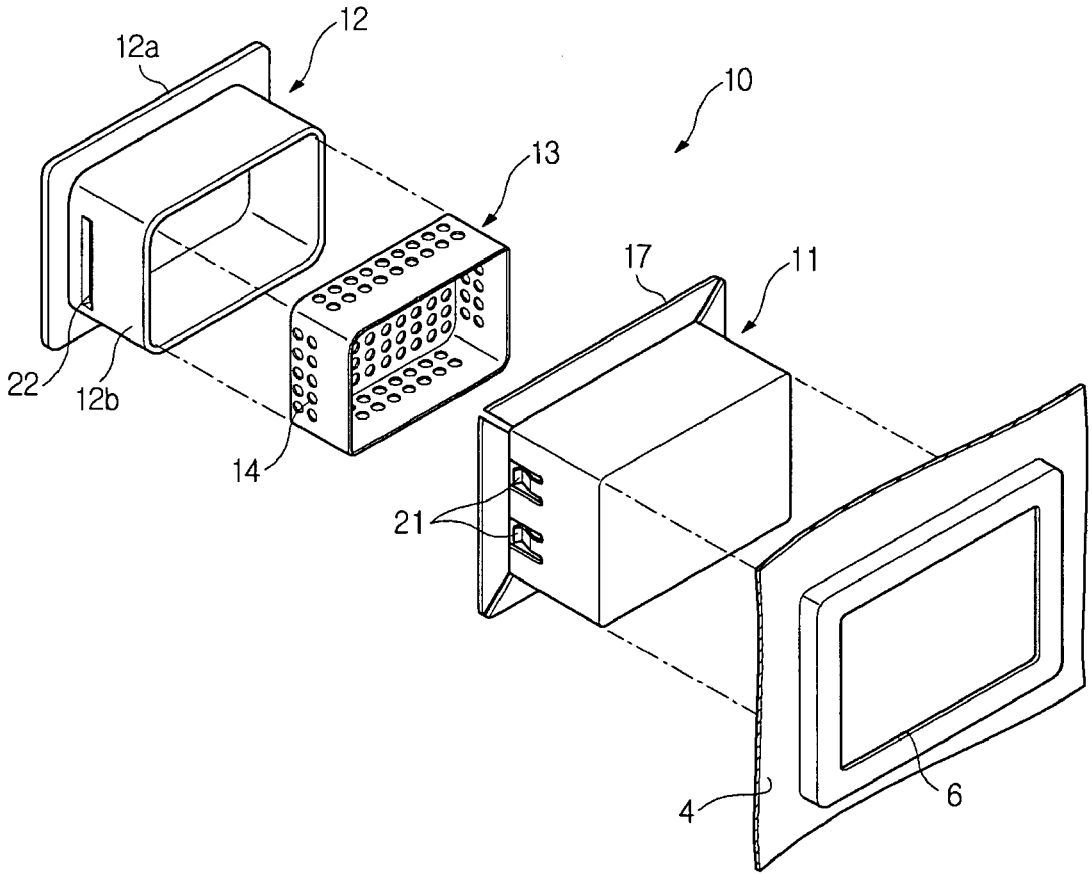
FIG. 2 is an exploded perspective view of the lamp assembly of FIG. 1, according to a first embodiment of the present invention.
Figure 3:
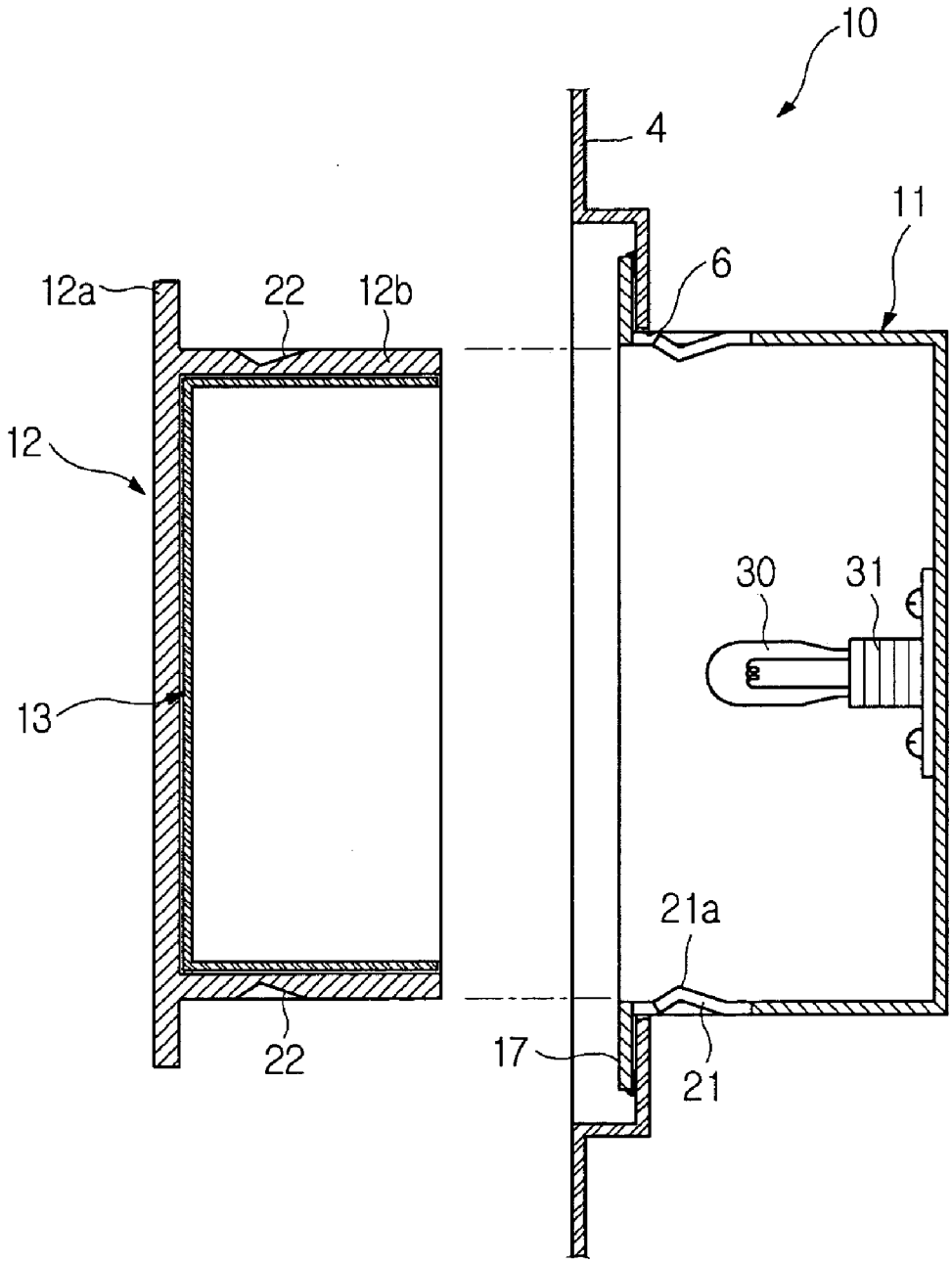
FIG. 3 is a cross section showing the lamp assembly of FIG. 2 that is partially assembled.
Figure 4:
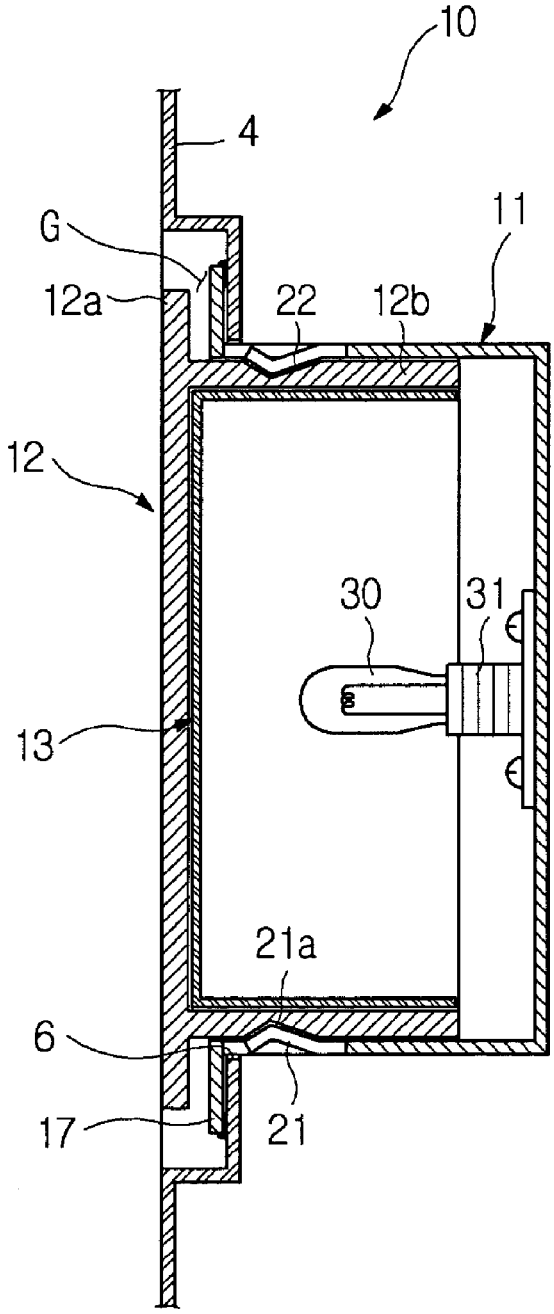
FIG. 4 is a cross section showing the lamp assembly of FIG. 2 that is completely assembled.

FIGS. 2 to 4 are views showing an assembly structure of the lamp assembly 10 according to a first embodiment of the present invention.

As shown in FIG. 2, the lamp assembly 10 is formed in a box shape open at a front thereof. The lamp assembly 10 includes a lamp casing 11 on which a lamp 30 (see FIG. 3) is mounted, a transparent cover 12 that covers the open front of the lamp casing 11 to prevent food from adhering to the lamp 30 and to pass light therethrough into the cooking cavity 2, and a lamp protecting member 13 located between the lamp casing 11 and the transparent cover 12 to stop microwaves irradiated from the cooking cavity 2 from being transmitted to the lamp 30.

A lamp mounting opening 6 is formed through the sidewall plate 4 of the cooking cavity 2 to be combined with the lamp casing 11 so as to allow the lamp assembly 10 to be mounted on a wall of the cooking cavity 2.

A flange 17 is radially outwardly extended from an edge of the open front of the lamp casing 11. Accordingly, the flange 17 is welded to the sidewall plate 4 with the lamp casing 11 inserted into the opening 6, so that the lamp casing 11 is fastened to the sidewall plate 4.

The transparent cover 12 includes a base plate 12*a* having a size corresponding to a size of the flange 17, and an inserted part 12*b* extending from the base plate 12*a* a certain distance to be fitted into the lamp casing 11.

The transparent cover 12 is made of a transparent material, such as glass or transparent plastic. The inserted part 12*b* is inserted into the lamp casing 11, so that the base plate 12*a* blocks a front of the lamp casing 11, thus preventing food from adhering to the lamp casing 11 on which the lamp 30 is mounted, and allowing light to be irradiated into the cooking cavity 2.

A plurality of elastic tongues 21 are formed on both sides of the lamp casing 11 to allow the transparent cover 12 to combine with the lamp casing 11 so that the transparent cover 12 is easily combined with and separated from the lamp casing 11. A plurality of locking depressions 22 are formed on the inserted part 12*b* of the transparent cover 12 to catch the elastic tongues 21.

The elastic tongues 21 and the locking depressions 22 are provided by structures formed in the transparent cover 12 and the lamp casing 11.

The elastic tongues 21 each have a predetermined size and extend from both sides of the lamp casing 11 to be elastically deformed. Accordingly, when the transparent cover 12 is inserted into the lamp casing 11, the elastic tongues 21 of the lamp casing 11 are radially outwardly pushed while coming into contact with the locking depressions 22 of the transparent cover 12.

Furthermore, projections 21*a* (FIG. 3) are formed on free ends of the elastic tongues 21 to be caught by the locking depressions 22 formed on both sides of the inserted part 12*b* of the transparent cover 12.

The locking depressions 22 and the projections 21*a* are formed in approximate wedge shapes so that the projections 21*a* are easily and selectively engaged with and disengaged from the locking depressions 22 as the transparent cover 12 is inserted into and removed from the lamp casing 11.

The lamp protecting member 13 is formed in a box shape open at a rear thereof, and is sized to come in tight contact with an inside of the inserted part 12*b* of the transparent cover 12 and to prevent the lamp protecting member 13 from being removed from the inserted part 12*b* of the transparent cover 12. The lamp protecting member 13 is provided with a plurality of holes 14 each having a size that allows the hole 14 to prevent microwaves from passing therethrough.

Accordingly, when the lamp protecting member 13 is fitted into the transparent cover 12, microwaves irradiated into the cooking cavity 2 are not transmitted to the lamp 30 while light irradiated from the lamp 30 is transmitted to the cooking cavity 2.

Meanwhile, since the lamp protecting member 13 is not necessary for cooking apparatuses that do not employ microwaves, the lamp protecting member 13 may or may not be a component of a lamp assembly.

A process of combining the lamp assembly 10 with the sidewall plate 4 of the cooking cavity 2 is described below.

As shown in FIG. 3, after the lamp casing 11 is inserted into the opening 6 formed in the sidewall plate 4 of the cooking cavity 2 with the lamp 30 being installed in a socket 31 mounted on the lamp casing 11, the lamp casing 11 is fastened to the sidewall plate 4 by welding the flange 17 of the lamp casing 11 to the sidewall plate 4. Meanwhile, the lamp protecting member 13 is fitted into the inserted part 12*b* of the transparent cover 12 to come in contact with the inside of the inserted part 12*b* of the transparent cover 12.

Subsequently, when the transparent cover 12 with the lamp protecting member 13 fitted thereinto is forced into the lamp casing 11, the inserted part 12*b* enters an inside of the lamp casing 11 while radially outwardly pushing the elastic tongues 21 formed in both sides of the lamp casing 11.

When in the above-described operation, the locking depressions 22 meet the elastic tongues 21, the elastic tongues 21 are stored to an original position thereof and are engaged with the locking depressions 22, so that the transparent cover 12 is combined with the lamp casing 11 to be easily detached from the lamp casing 11, as shown in FIG. 4.

When the transparent cover 12 is fitted into the lamp casing 11, a predetermined gap G is formed between the base plate 12*a* and the lamp casing 11. Therefore, when a user inserts fingers into the gap G and pulls the transparent cover 12, the elastic tongues 21 are radially outwardly deformed by the inserted part 12*b* of the transparent cover 12, and thus, the projections 21*a* of the elastic tongues 21 are separated from the locking depressions 22. Subsequently, the transparent cover 12 may be conveniently separated from the lamp casing 11.

After the transparent cover 12 is separated from the lamp casing 11 as described above, access to the inside of the lamp casing 11 is given, so that the lamp 30 is removed from the socket 31 and quickly replaced.

Figure 5:
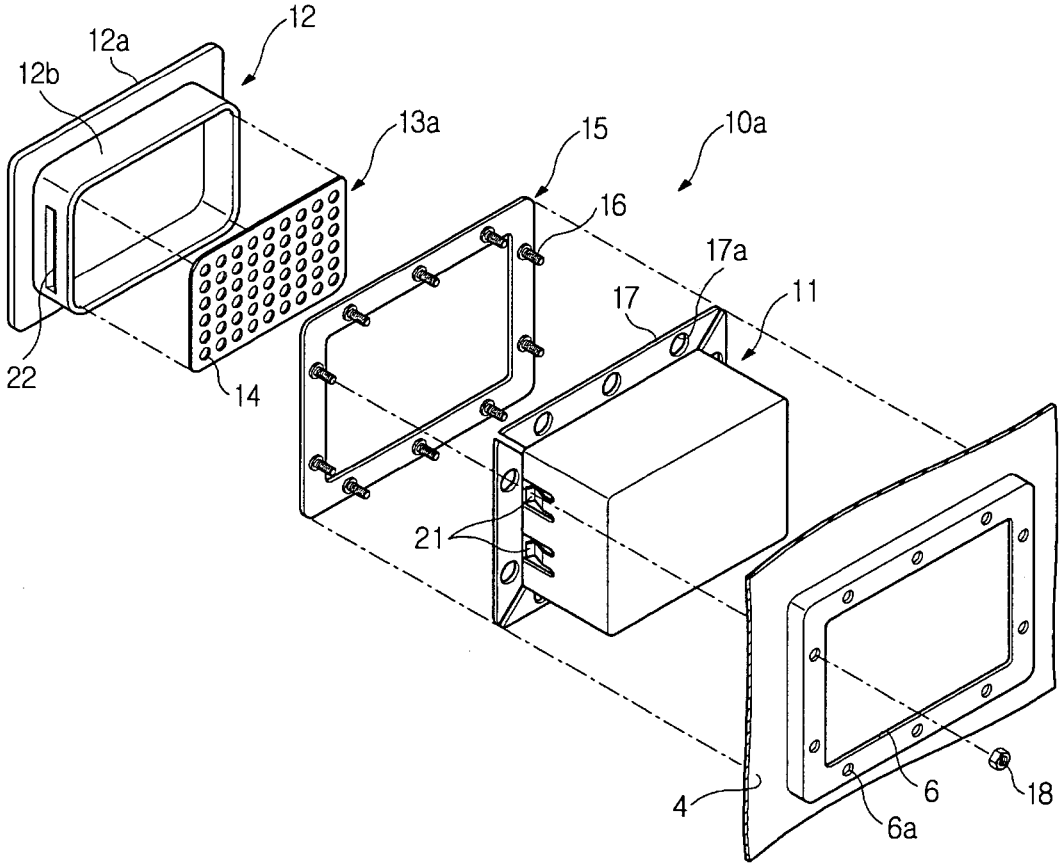
FIG. 5 is an exploded perspective view of the lamp assembly of FIG. 1, according to a second embodiment of the present invention.
Figure 6:
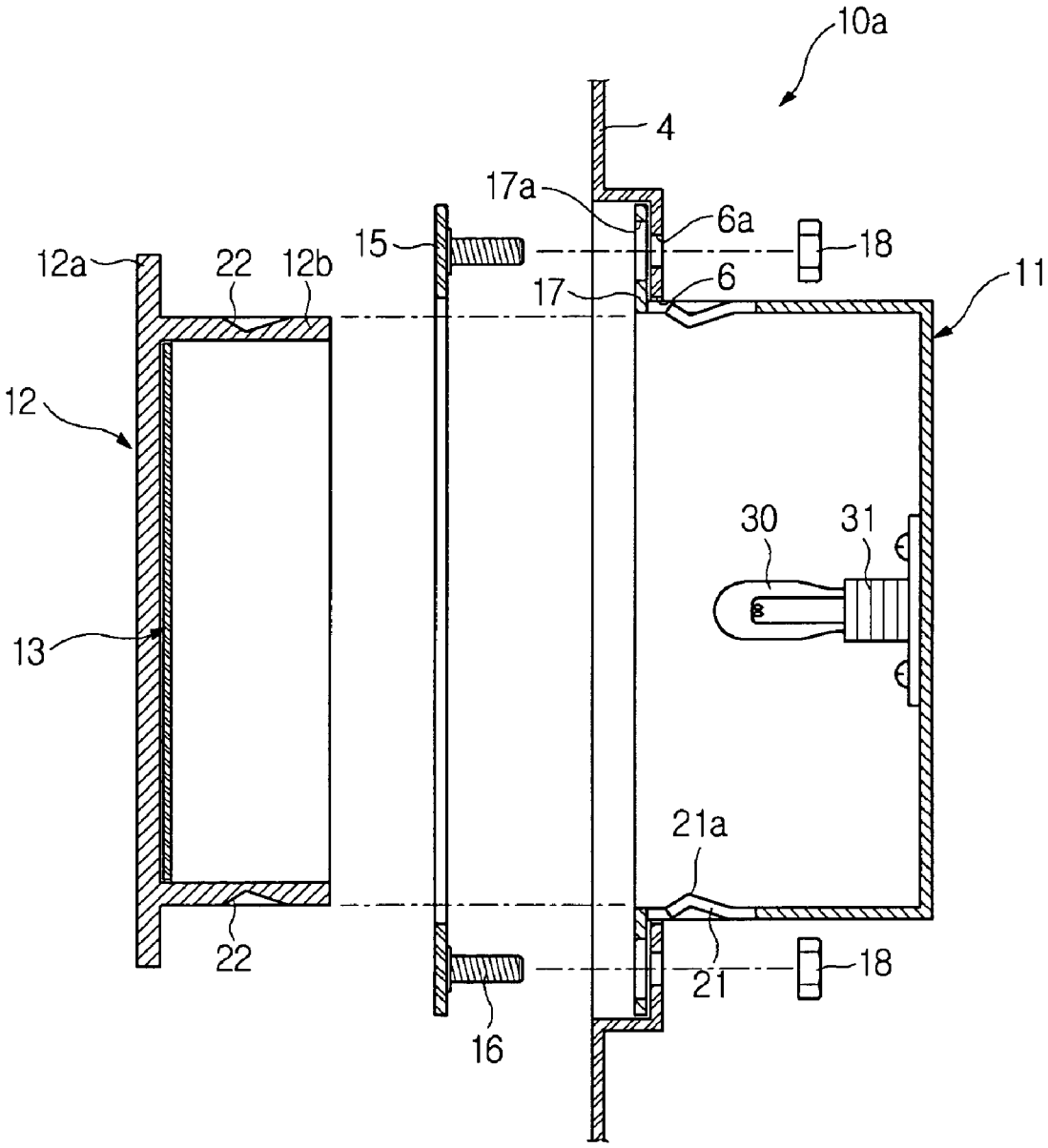
FIG. 6 is a cross section showing the lamp assembly of FIG. 5 that is partially assembled.
Figure 7:
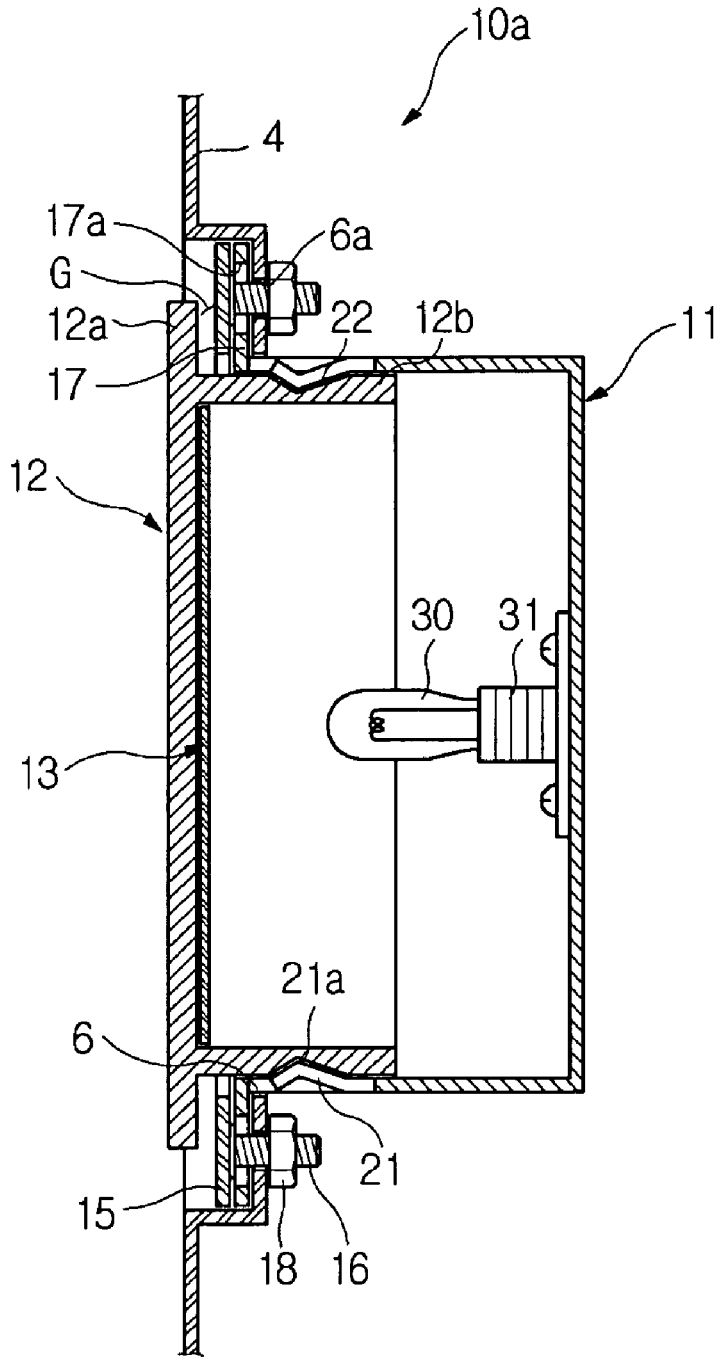
FIG. 7 is a cross section showing the lamp assembly of FIG. 5 that is completely assembled.

FIGS. 5 to 7 are views showing an assembly structure of a lamp assembly 10*a*, according to a second embodiment of the present invention. Since the lamp assembly 10*a* according to the second embodiment is are similar to the lamp assembly 10 of the first embodiment, a complete description is omitted herein.

As shown in FIG. 5, the lamp assembly 10*a* according to the second embodiment includes the lamp casing 11 formed in an approximate box shape open at a front thereof and provided with the plurality of elastic tongues 21 on both sides thereof, the transparent cover 12 provided with the plurality of locking depressions 22 to catch the elastic tongues 21, and a lamp protecting member 13*a* formed in a plate shape to come in tight contact with an inside of the transparent cover 12 and provided with the plurality of holes 14, each having a size that allows the hole 14 to prevent microwaves from passing therethrough.

The transparent cover 12 includes the base plate 12*a*, and the inserted part 12*b* extending from the base plate 12*a*. When the inserted part 12*b* of the transparent cover 12 is inserted into the lamp casing 11, the elastic tongues 21 are caught by the locking depressions 22, and thus, the transparent cover 12 is combined with the lamp casing 11 to be easily separated from the lamp casing 11.

The lamp assembly 10*a* according to the second embodiment further includes a fastening plate 15 to fasten the lamp casing 11 to the opening 6 formed through the sidewall plate 4 of the cooking cavity 2.

The fastening plate 15 is formed in a frame shape open at a center portion thereof to correspond to a size of the lamp casing 11. A plurality of bolts 16 are inserted into the fastening plate 15, which is sized to correspond to the flange 17 of the lamp casing 11, at regular intervals. Furthermore, a plurality of bolt holes 6*a* (FIG. 6) are formed through the sidewall plate 4 at locations around the opening 6 of the sidewall plate 4 at regular intervals to correspond to the bolts 16 inserted into the fastening plate 15 and through holes 17*a* formed through the flange 17 of the lamp casing 11.

The process of attaching the lamp assembly 10*a* to the sidewall plate 4 is described below. As shown in FIG. 6, the lamp casing 11 is inserted into the opening 6 of the sidewall plate 4 to allow the through holes 17*a* to be aligned with the bolt holes 6*a*, and the lamp protecting member 13*a* is inserted into the inserted part 12*b* of the transparent cover 12 to be brought into tight contact with the inserted part 12*b* of the transparent cover 12.

Thereafter, when the fastening plate 15 is brought into tight contact with the flange 17 of the lamp casing 11, the bolts 16 inserted through the fastening plate 15 are passed through and projected from the through holes 17*a* of the lamp casing 11 and the bolt holes 6*a* of the sidewall plate 4, and the lamp casing 11 is fastened to the sidewall plate 4 by tightening nuts 18 onto the bolts 16, as shown in FIG. 7.

In the above-described state, when the transparent cover 12 with the lamp protecting member 13*a* inserted thereinto is forced into the lamp casing 11, the projections 21*a* of the elastic tongues 21 provided on the lamp casing 11 are caught by the locking depressions 22 provided on the inserted part 12*b* of the transparent cover 12, so that the transparent cover 12 is combined with the lamp casing 11 to be easily separated from the lamp casing 11, as in the first embodiment.

A process of separating the transparent cover 12 from the lamp casing 11 and replacing the lamp 30 after the transparent cover 12 has been inserted into the lamp casing 11 is similar to the process of the first embodiment. Accordingly, a description of the process is omitted here.

As described above in detail, the cooking apparatus having the lamp assembly according to the embodiments of the present invention has a structure allowing the transparent cover to be easily and selectively combined with and separated from the lamp casing, so that the lamp mounted on the lamp casing is quickly and conveniently replaced, thus being more desirable for the consumer.

Although a few embodiments of the present invention have been shown and described, it would be appreciated by those skilled in the art that changes might be made in these embodiments without departing from the principles and spirit of the invention, the scope of which is defined in the claims and their equivalents.

What is claimed is:

1. A cooking apparatus to cook food using microwaves, comprising:

a body defining a cooking cavity;

an opening formed through a side of the body;

a lamp assembly mounted on the opening, the lamp assembly comprising:

a lamp casing mounted with a lamp, and a transparent cover engaged with the lamp casing by hooking to be selectively combined with or separated from the lamp casing; and a lamp protecting member to prevent the microwaves from passing to the lamp, the lamp protecting member spanning an entirety of the transparent cover, wherein the lamp casing comprises an elastic tongue, the transparent cover comprises a locking depression to engage with the elastic tongue, the elastic tongue is formed to have a size by cutting a portion of a side of the lamp casing to be radially and elastically deformed, and has a projection at a free end thereof, the locking depression is formed on a side of the transparent cover and engages with the elastic tongue, the lamp casing comprises a flange radially outwardly extending from a front edge thereof, the transparent cover comprises:

a base plate covering a front of the lamp casing, and an inserted part extending from the base plate to a length to be inserted into the lamp casing, and the lamp protecting member defines a plurality of holes each having a size that allows the respective hole to prevent the microwaves from passing therethrough.

2. The cooking apparatus as set forth in claim 1, wherein the locking depression and the projection are approximately wedge shaped to be selectively engaged with and disengaged from each other as the transparent cover is selectively inserted into and removed from the lamp casing.

3. The cooking apparatus as set forth in claim 1, wherein the lamp casing is fastened to the side of the body by welding the flange of the lamp casing to a portion of the side of the body around the opening.

4. The cooking apparatus as set forth in claim 1, wherein the lamp assembly further comprises a fastening plate having a frame constructed to correspond to the flange of the lamp casing, and the cooking apparatus further comprises:

a plurality of bolts to fasten the fastening plate to the side of the body, and a plurality of nuts tightened on the bolts, the bolts passing through the flange of the lamp casing and the side of the body.

5. A cooking apparatus, comprising:

a body defining a cooking cavity;

an opening formed through a side of the body; and a lamp assembly mounted on the opening, the lamp assembly comprising:

a lamp casing mounted with a lamp, and a transparent cover engaged with the lamp casing by hooking to be selectively combined with or separated from the lamp casing, wherein:

one of the lamp casing and the transparent cover comprises an elastic tongue, another one of the lamp casing and the transparent cover comprises a locking depression to engage with the elastic tongue, the elastic tongue is formed to have a size by cutting a portion of a side of the lamp casing to be radially and elastically deformed, and has a projection at a free end thereof, the locking depression is formed on a side of the transparent cover and engages with the elastic tongue, the lamp casing comprises a flange radially outwardly extending from a front edge thereof, the transparent cover comprises:

a base plate covering a front of the lamp casing, and an inserted part extending from the base plate to a length to be inserted into the lamp casing, the cooking apparatus cooks food using microwaves, the apparatus further comprising a lamp protecting member located between the lamp casing and the transparent cover and defining a plurality of holes each having a size that allows the respective hole to prevent the microwaves from passing therethrough, and the lamp protecting member has a plate shape and is brought into contact with an inside of the base plate of the transparent cover.

6. A cooking apparatus, comprising:

a body defining a cooking cavity;

an opening formed through a side of the body; and a lamp assembly mounted on the opening, the lamp assembly comprising:

a lamp casing mounted with a lamp, and a transparent cover engaged with the lamp casing by hooking to be selectively combined with or separated from the lamp casing, wherein:

one of the lamp casing and the transparent cover comprises an elastic tongue, another one of the lamp casing and the transparent cover comprises a locking depression to engage with the elastic tongue, the elastic tongue is formed to have a size by cutting a portion of a side of the lamp casing to be radially and elastically deformed, and has a projection at a free end thereof, the locking depression is formed on a side of the transparent cover and engages with the elastic tongue, the lamp casing comprises a flange radially outwardly extending from a front edge thereof, the transparent cover comprises:

a base plate covering a front of the lamp casing, and an inserted part extending from the base plate to a length to be inserted into the lamp casing, the cooking apparatus cooks food using microwaves, the apparatus further comprising a lamp protecting member located between the lamp casing and the transparent cover and defining a plurality of holes each having a size that allows the respective hole to prevent the microwaves from passing therethrough, wherein the lamp protecting member has a box shape and is brought into contact with an inside of the inserted part of the transparent cover.

7. A lamp assembly to cook food using microwaves, comprising:

a lamp;

a lamp casing opened at a front thereof, mounted with the lamp, and comprising an elastic tongue on a side thereof;

a transparent cover inserted into the lamp casing through the opened front of the lamp casing, and comprising:

a side, and a locking depression on the side to operate in conjunction with the elastic tongue to selectively combine and separate the transparent cover with and from the lamp casing; and a lamp protecting member to prevent the microwaves from passing to the lamp, the lamp protecting member spanning an entirety of the transparent cover, wherein the elastic tongue is formed to have a size by cutting a portion of a side of the lamp casing to be radially and elastically deformed, and has a projection at a free end thereof, the lamp casing further comprises a flange radially outwardly extending from a front edge thereof, the transparent cover further comprises:

a base plate covering a front of the lamp casing, and an inserted part extending from the base plate to a length to be inserted into the lamp casing, and the lamp protecting member is located between the lamp casing and the transparent cover and defines a plurality of holes each having a size that allows the respective hole to prevent the microwaves from passing therethrough.

8. The lamp assembly as set forth in claim 7, wherein when the inserted pad of the transparent cover is inserted into the lamp casing, the projection of the elastic tongue is engaged with the locking depression formed on the transparent cover.

9. The lamp assembly as set forth in claim 7, wherein the locking depression and the projection have approximately wedge shapes to be selectively engaged with and disengaged from each other as the transparent cover is selectively inserted into and removed from The lamp casing.

10. A cooking apparatus to cook food using microwaves, comprising:

a lamp;

a lamp casing mounted with the lamp;

a cover to cover the lamp, comprising a first attaching/detaching unit and a transparent portion opposite the lamp;

a body to receive the lamp and comprising a second attaching/detaching unit to selectively engage with/disengage from the first attaching/detaching unit; and a lamp protecting member to prevent the microwaves from passing to the lamp, the lamp protecting member spanning an entirety of the transparent portion, wherein the first attaching/detaching unit comprises an elastic tongue, the second attaching/detaching unit comprises a locking depression to engage with the elastic tongue, the elastic tongue is formed to have a size by cutting a portion of a side of the lamp casing to be radially and elastically deformed, and has a projection at a free end thereof, the locking depression is formed on a side of the cover and engages with the elastic tongue, the lamp casing comprises a flange radially outwardly extending from a front edge thereof, the cover further comprises a base plate covering a front of the lamp casing, and the lamp protecting member is located between the lamp casing and the transparent cover and defines a plurality of holes each having a size that allows the respective hole to prevent the microwaves from passing therethrough.

11. The cooking apparatus as set forth in claim 10, wherein a gap is defined between the cover and the body.

* * * * *

UNITED STATES PATENT AND TRADEMARK OFFICE

CERTIFICATE OF CORRECTION

PATENT NO. : 7,267,450 B2
APPLICATION NO. : 10/869846
DATED : September 11, 2007
INVENTOR(S) : Yu Jeub Ha It is certified that error appears in the above-identified patent and that said Letters Patent is hereby corrected as shown below:

Title Page, Column 2 (Abstract), Line 13, change “memberincluding” to --member including--.

Column 9, Line 11, change “pad” to --part--.

Column 9, Line 19, change “The” to --the--.

Signed and Sealed this

Fourth Day of March, 2008

JON W. DUDAS
*Director of the United States Patent and Trademark Office*